United States Patent [19]

Powers

[11] Patent Number: 4,649,890

[45] Date of Patent: Mar. 17, 1987

[54] COMPOUND BOW WITH PLANAR COMPONENTS

[76] Inventor: John E. A. Powers, 301 Ridgeview Rd., Princeton, N.J. 08540

[21] Appl. No.: 618,940

[22] Filed: Jun. 8, 1984

[51] Int. Cl.[4] ..... F41B 5/00

[52] U.S. Cl. ..... 124/24 R; 124/DIG. 1

[58] Field of Search ..... 124/23 R, 24 R, DIG. 1

[56] References Cited

U.S. PATENT DOCUMENTS

| | | | |
|---|---|---|---|
| 3,967,609 | 7/1976 | Frydenlund | 124/24 R |
| 4,076,005 | 2/1978 | Hill | 124/24 R |
| 4,401,097 | 8/1983 | Simonds et al. | 124/23 R |
| 4,461,267 | 7/1984 | Simonds et al. | 124/23 R |
| 4,465,054 | 8/1984 | Nishioka | 124/24 R |
| 4,467,288 | 7/1984 | Ricord | 124/23 R |

OTHER PUBLICATIONS

"Bowhunting", publication by Chuck Adams, Winchester Press, 1978, pp. 24–28.

*Primary Examiner*—Richard C. Pinkham
*Assistant Examiner*—Benjamin Layno

[57] ABSTRACT

A compound bow that uses mechanical advantage for interconnecting the bowstring with the resilient bow limbs is configured in such a way that all components of the mechanical advantage are positioned to lie outside the immediate vicinity of the arrow position, thereby permitting the bowstring to be aligned with the centerline of the limbs and further permitting all vector forces operating on the bowstring, limbs, and mechanical advantage to lie in a common plane, thus minimizing twisting torques applied to the limbs. In an embodiment comprising cables attached to cams as part of the mechanical advantage, the use of rotating cable-end fasteners minimizes the friction from cable flexing.

6 Claims, 8 Drawing Figures

COMPOUND BOW WITH PLANAR COMPONENTS

This invention relates to the design of compound bows for archery and hunting, and more particularly, to improvements in the accuracy, shootability and energy efficiency of such bows.

BACKGROUND OF THE INVENTION

The concept of the compound bow introduced mechanical advantages over the traditional straight and recurved bow designs whereby a system of cables, cams, and pulleys were interposed between the bowstring and the bow limbs to provide mechanical advantage in the draw and a property called let-off, that is, the force required to hold the bowstring at full draw length is substantially lower than that required to hold said bowstring at intermediate draw length. The force that propels the arrow at any instantaneous position of the bowstring after release is approximately equal to that force required to hold the bowstring stationary in that position, thus in a compound bow, the arrow is subjected to higher acceleration at an intermediate position during release than would have been the case with a traditional bow of the same holding force at full draw. Thus compound bows result in higher arrow velocity. Also, arrows can be shot from such bows with more accuracy, as the archer is subjected to lower stress while aiming at full draw than in the case of traditional bow designs.

Compound bows have changed little in their basic designs although improvements in the eccentric cams and cable arrangements have resulted in increased arrow velocity. Prior art compound bows typically contain a pair of cables that almost span the entire space between the limb tips in such a way that these cables cross over each other and would interfere with the patch of the arrow were it not for the presence of special means to hold the cables aside. One such special means involves the use of a cable guard comprising a rod attached to the bow handle riser, said rod being offset from the centerline of the limbs and positioned between the cables and said centerline, thus holding the cables aside to provide clearance between the cables and the arrow path.

Another such special means involves the use of dual-grooved cams or pulleys at the limb tips with one or both grooves offset from said centerline and arranged in such a way that the primary cable attached directly to the bowstring is disposed in a different groove from that in which is disposed the secondary cable attached to the opposite limb tip. The spacing between the grooves provides the necessary cable clearance to avoid interference with the arrow path.

Both of the above special means to avoid cable interference suffer a common disadvantage that can impact arrow flight accuracy. Any offsetting of the cables, cams, or bowstring from the centerline of the bow limbs can result in an imbalance in cable tensions and a corresponding torque or twisting of the limbs. The energy stored in such twisting is not only wasted as the arrow is released but the relaxation of the torque forces can impart minute sideways motion of the bowstring and consequently cause unstable arrow flight. An additional disadvantage of the crossing over of the cables is that they can touch each other causing chafing and also dissipate energy in the process of rubbing together.

It is thus a desirable feature in a compound bow design to align all cables, cams, and pulleys with respect to the centerline of the limbs in such a way as to balance the forces acting on said limbs to avoid torque or twisting moments. It is also desirable that the bowstring be accurately aligned with said centerline and further that the cables not come in contact with each other.

OBJECT OF THE INVENTION

It is an object of the present invention to provide a compound bow design in which all components involved in energy transfer and storage have centerlines positioned in a common plane.

It is a second object of this invention to provide a compound bow design that contains no interfering components in the vicinity of the arrow path.

It is a further object of this invention to provide means to reduce friction and loss of energy from cable contact and from cable flexing.

SUMMARY OF THE INVENTION

The compound bow of the present invention uses a system of cams, cables, and pulleys arranged in such a way that no cable attached to a given limb tip crosses over to the opposite limb tip to interfere with the arrow path. This positioning of the cables permits the centerlines of the bowstring, cables, cams, pulleys, and limbs to lie in a single plane thus drawing the bowstring imparts no twisting torque forces on the limbs, cams, or pulleys. In a particular embodiment of the invention, all cable attachments are provided through rotatable fittings to minimize cable flexing as the bowstring is drawn.

DETAILED DESCRIPTION OF THE INVENTION

Figure 1:
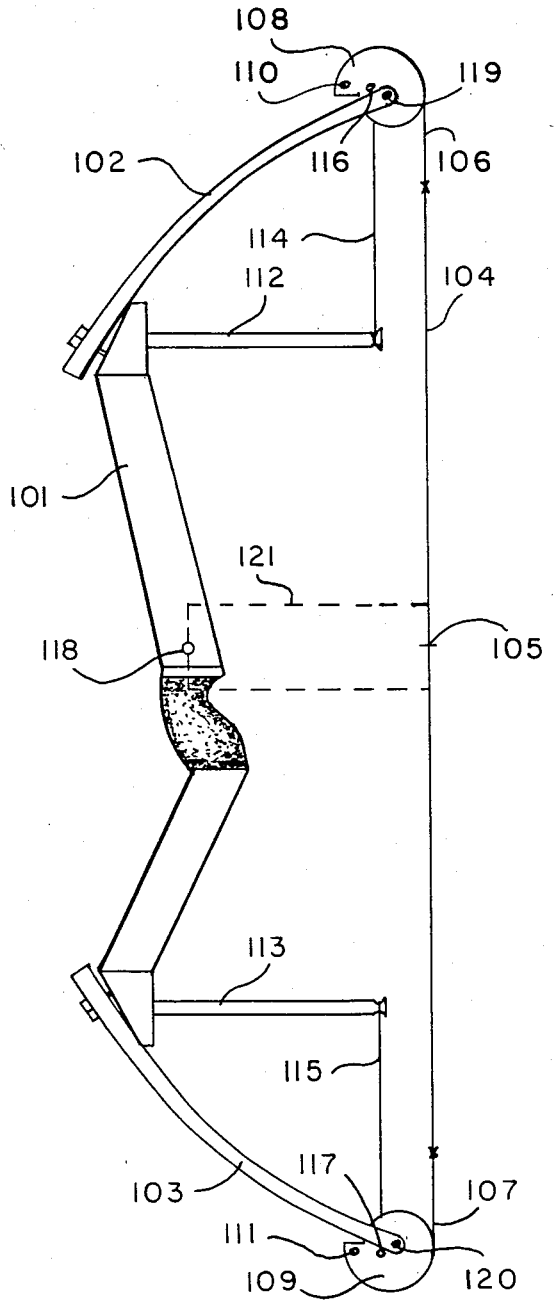
FIG. 1 shows a side elevation view of a simple embodiment of the invention.

FIG. 1 illustrates a compound bow that incorporates the principles of the present invention. In common with bows of the prior art, this embodiment comprises a handle riser 101 with arrow rest point 118 where the arrow rests against the handle riser, a pair of outwardly extending resilient limbs 102 and 103, hereinafter referred to as the upper and lower limbs, respectively, a bowstring 104 with nocking point 105 (with or without a physical marker), a pair of primary cables 106 and 107 attached to said bowstring at one end and disposed in the grooves of cams 108 and 109, respectively, said cables being attached at their opposite ends to said cams at primary cable end fasteners 110 and 111, respectively, said fasteners being near the tip of that portion of said cams of larger radius hereinafter referred to as the primary portion.

In contradistinction from prior art bows, the embodiment of FIG. 1 contains no cables or other components between the bowstring and handle riser in the immediate vicinity of the arrow position. The four-sided figure 121 corresponds to the arrow position region. A pair of cantilever bars 112 and 113 are attached firmly to handle riser 101 and to which are attached secondary cables 114 and 115, respectively. These cables, in turn, are attached at their opposite ends to secondary cable end fasteners 116 and 117 on cams 108 and 109, respectively, said secondary cable end fasteners being located near the outer edge of that portion of said cams being of smaller radius, hereinafter referred to as the secondary portion.

Cams 108 and 109 are affixed to the outer tips of limbs 102 and 103 via axles 119 and 120, said axles allow said cams to rotate when the bowstring is drawn. Cable end fasteners 110, 111, 116, and 117 are similarly attached to said cams via cable end fastener axles that permit said cable end fasteners to rotate and minimize cable flexing at the attachment point. Cable flexing causes friction and loss of energy, and can result in a reduction in the distance of arrow flight.

Figure 2:
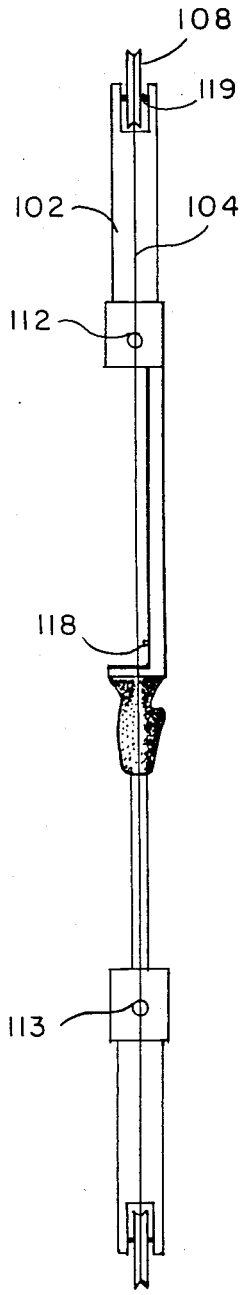
FIG. 2 is a rear elevation view of the embodiment of FIG. 1 showing the alignment of the mechanism components.

As illustrated in FIG. 2, all components involved in the storage and exchange of energy are positioned in centerline with respect to each other. That is, the centerlines of the limbs, cams, cables, bowstring and cantilever bars all lie in a single plane perpendicular to the limb faces. As the bowstring is drawn, all vector forces constituting tension in the bowstring and cables and the reactive force vectors of the limbs and cantilever bars similarly lie in the same plane. Therefore negligible torque vectors are imparted to the limbs that would result in sideways motion of the bowstring and would interfere with arrow flight stability.

The upper and lower mechanisms of the bow are near-symmetrically disposed about an imaginary center line that connects arrow rest point 118 with nocking point 105, constituting the arrow position. All motions and forces act in mirror image between the upper and lower mechanisms, thus further description of the bow action will address the upper mechanisms only.

Figure 3:
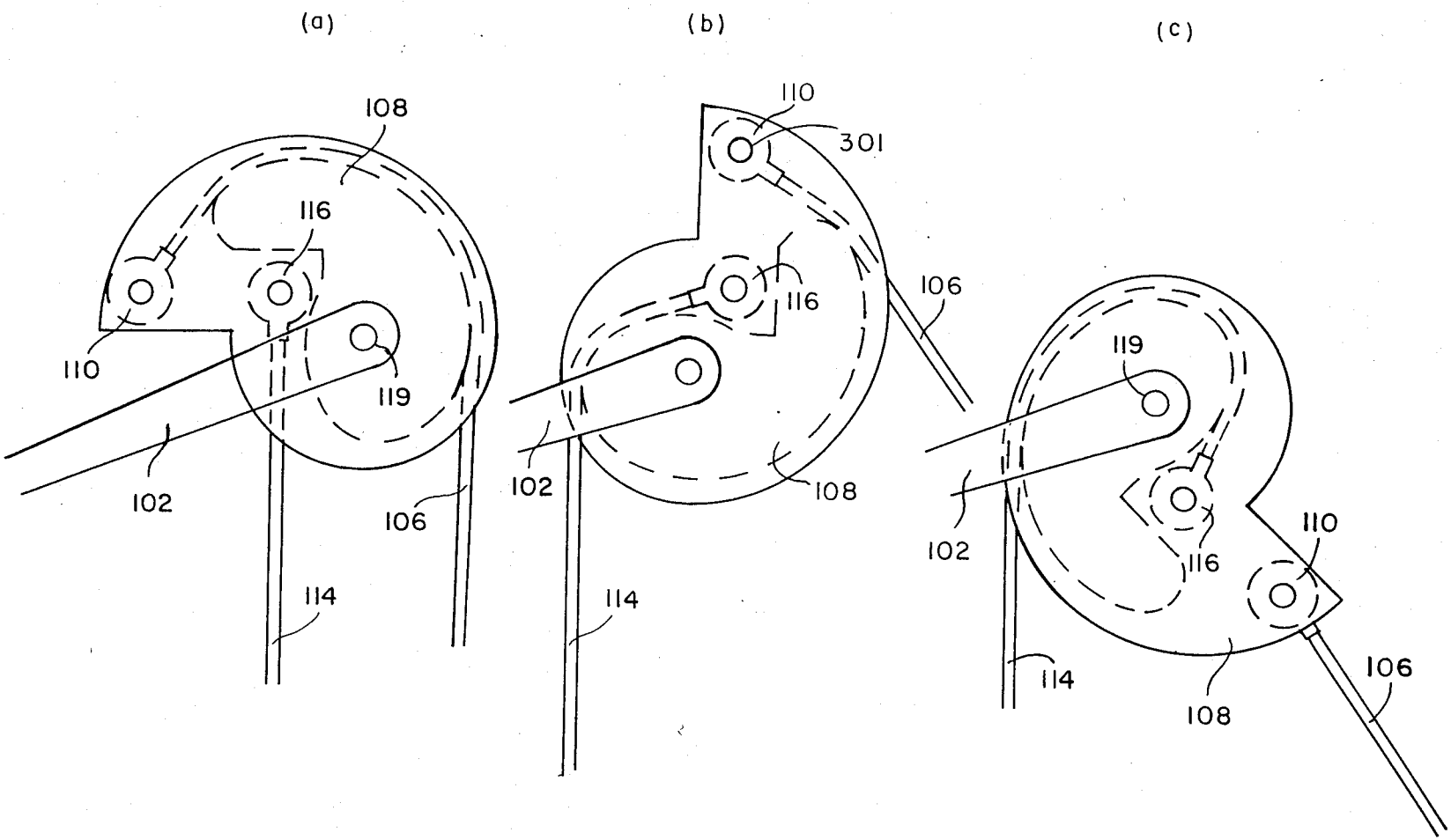
FIG. 3 is a detail view of the upper eccentric cam in three positions: at rest, at intermediate draw, and at full draw.

When the archer begins to draw back bowstring 104 at nocking point 105, tension in said bowstring is imparted to upper primary cable 106 causing cam 108 to rotate. This tension is transferred by said cam to secondary cable 114 with amplification derived from leverage between the primary and secondary portions of said cam, said leverage resulting from the larger radius of said primary portion and the smaller radius of said secondary portion. As said secondary cable does not stretch, its tension is further imparted as a bending moment to limb 202 and to cantilever bar 112 which bend to balance forces, storing energy as upper and lower limb tips compress towards each other. As the archer approaches intermediate draw, cam 108 rotates to its intermediate position as shown in FIG. 3*b*, where maximum leverage exists between primary and secondary portions of said cam, as said primary portion has reached its maximum radius. At about this point primary cable end fastener 110 begins to rotate about axle 301 thus primary cable 106 lifts out of the groove in cam 108 and ceases to flex as the archer continues toward full draw. Tension in said primary cable begins to relax near the intermediate position and the archer experiences "let off" of the force required to hold the bowstring as he approaches full draw. When said archer has reached full draw and cam 108 is in the fully rotated position of FIG. 3*c*, the mechanical advantage or leverage of the cam stops abruptly and it is virtually impossible for the archer to overdraw the bow and damage the limbs as he must now apply the full force of the limb compression. At the point near full draw where the tension in the bowstring has reached its minimum, the archer can hold the bowstring with substantially reduced force thus taking aim under substantially reduced stress as compared with that from a traditional bow of the same stored energy.

Figure 4:
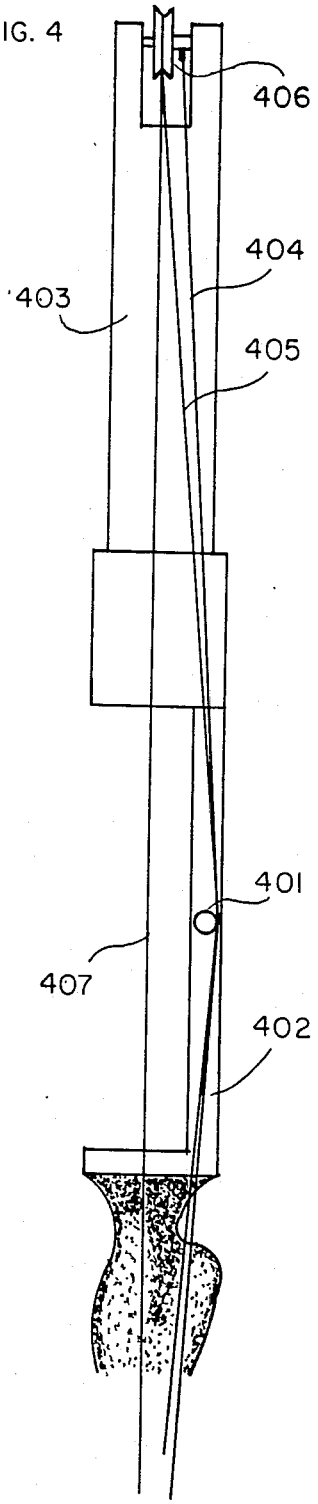
FIG. 4 is a rear elevation view of a prior art compound bow with cable guard showing the alignment of the mechanism components.

FIG. 4 shows a prior art compound bow employing a cable guard 401. Said cable guard comprises a rod affixed to handle riser 402 and positioned off center from the centerline of limb 403. Secondary cables 404 and 405 are pulled aside and placed on the opposite side of said cable guard from bowstring 407. Cam 406 and bowstring 407 are also offset from said centerline to reduce torque forces on said limb. However, imbalance in the tensions on the cables will occur during draw and will produce a twisting torque, however minute, that can impact arrow flight stability.

Figure 5:
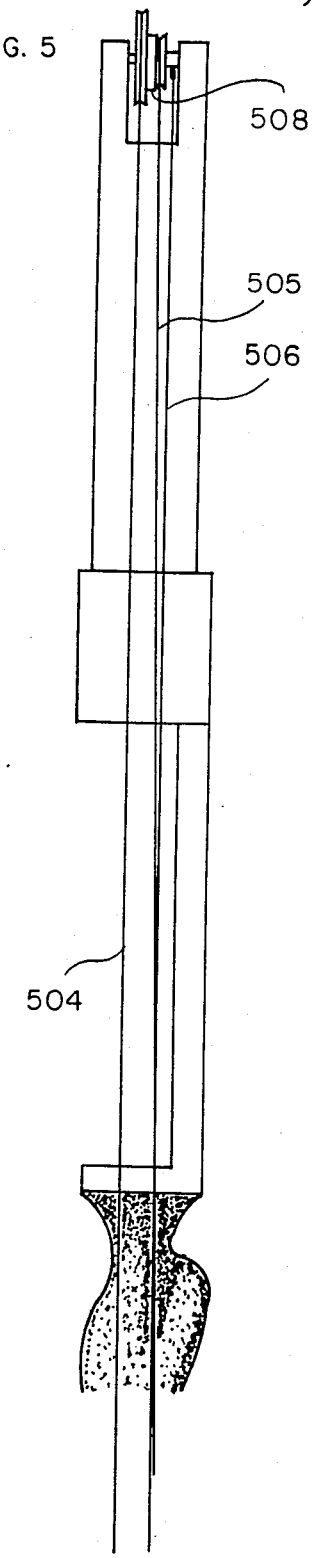
FIG. 5 shows another prior art bow with dual groove cams.

FIG. 5 shows another prior art compound bow that utilizes twin cams 508 with spaced grooves to provide separation between the bowstring and secondary cables. As in the case of the bow of FIG. 4, both the bowstring and the secondary cables are offset from the centerline of the limb to minimize twisting moments or torque on said limb. As was the case with the bow of FIG. 4, imbalance in the tensions on the cables will occur during draw which can impart arrow flight stability.

Figure 6:
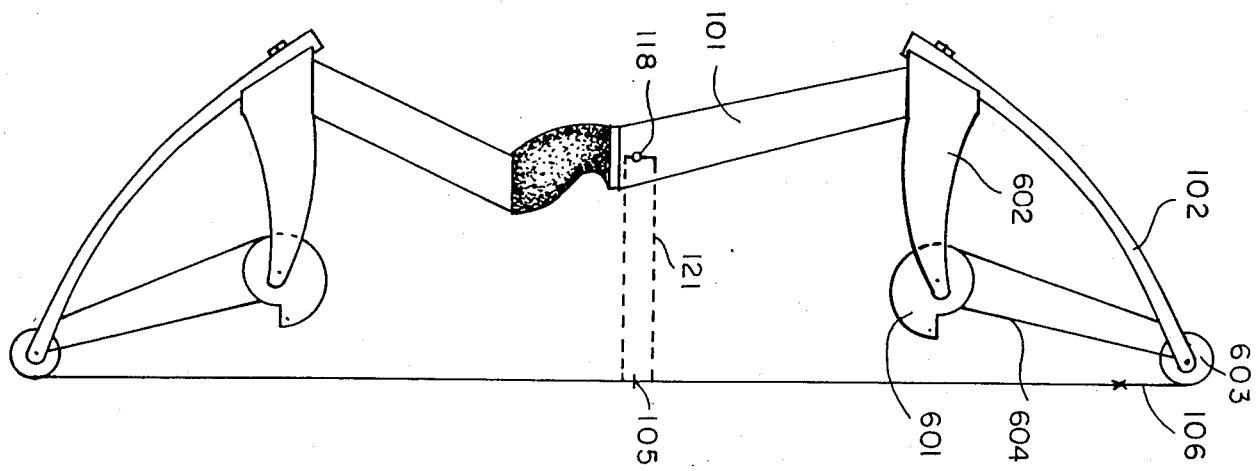
FIG. 6 shows an alternate embodiment of the invention.

FIG. 6 illustrates an alternate embodiment of the present invention. The mechanical advantage elements are positioned outside the immediate area of the arrow position as in the embodiment of FIG. 1. Cam 601 is positioned on a hanger 602 attached firmly to handle riser 101. Pulley 603 is attached via axles to the tip of limb 102 to carry primary cable 106 disposed in a groove on the outer perimeter of said pulley. Said primary cable is further disposed in the groove of the primary portion of cam 601 and is attached to said cam by a rotatable cable end fastener via an axle. Secondary cable 604 is disposed in the groove of the secondary portion of cam 601 where it is similarly attached by a rotating cable end fastener via an axle affixed to said cam. Said secondary cable at its opposite end is affixed to another rotatable cable end fastener via an axle attached to the limb tip. The embodiment of FIG. 6 has the advantage that there are three cable members over which to distribute the limb compression force, thus this embodiment has more mechanical advantage than that of FIG. 1. A further advantage is that the relatively heavy cams are positioned nearer the center of gravity of the bow.

It should be obvious to those skilled in the art that other embodiments with centerline or planar components can be configured to avoid positioning said components in the area of the arrow position.

What is claimed is:

1. A bow adapted for shooting an arrow, comprising:

a handle riser including upper and lower ends;

an outwardly extending resilient upper limb having first and second extreme ends the lower of which is affixed to said upper end of said handle riser, said upper limb being symmetrically disposed relative to a plane;

an outwardly extending resilient lower limb having first and second extreme ends, the upper of which is affixed to said lower end of said handle riser, said lower limb being symmetrically disposed relative to said plane;

a first cam arrangement including a first axle transverse to said plane and coupled to one of said first and second extreme ends of said upper limb, said first cam arrangement including first and second cam surfaces having centerlines that lie in said plane and arranged for simultaneous rotation about said first axle, said first cam surface having a radius from said first axle which varies with rotation, said second cam surface having at all rotational positions a smaller radius from said first axle;

a second cam arrangement including a second axle transverse to said plane and coupled to one of said first and second extreme ends of said lower limb, said second cam arrangement including first and second cam surfaces having centerlines that lie in said plane and arranged for simultaneous rotation about said second axle, said first cam surface having a radius from said second axle which varies with rotation, said second cam surface having at all rotational positions a smaller radius from said second axle;

a bowstring with centerline lying in said plane and when relaxed being perpendicular to an axis of thrust of the arrow, the centerline of which lies in said plane, said bowstring having upper and lower ends;

first tension means with centerline lying in said plane and entirely above said axis of thrust, said first tension means being connected to said upper end of said bowstring and to said first cam surface of said first cam arrangement;

second tension means with centerline lying in said plane and entirely below said axis of thrust, said second tension means being connected to said lower end of said bowstring and to said first cam surface of said second cam arrangement, whereby drawing said bowstring rotates said first and second cam arrangements with a mechanical advantage which is initially small and which increases with the amount of draw up to a point of intermediate draw;

third tension means with centerline lying in said plane and entirely above said axis of thrust, said third tension means being coupled to the upper end of said handle riser and to said second cam surface of said first cam arrangement;

fourth tension means with centerline lying in said plane and entirely below said axis of thrust, said fourth tension means being coupled to the lower end of said handle riser and to said second cam surface of said second cam arrangement, whereby draw of said bowstring initially requires an increasing amount of force up to a point of intermediate draw, and requires less force near full draw due to said mechanical advantage.

2. A bow according to claim 1 wherein said first and second cam surfaces of said first and second cam arrangements are grooved;

said first tension means comprises a first cable sheaved in said groove in said first cam surface of said first cam arrangement during at least a portion of said rotation thereof;

said second tension means comprises a second cable sheaved in said groove in said first cam surface of said second cam arrangement during at least a portion of said rotation thereof;

said third tension means comprises a third cable sheaved in said groove in said second cam surface of said first cam arrangement; and said fourth tension means comprises a fourth cable sheaved in said groove in said second cam surface of said second cam arrangement.

3. A bow according to claim 1, wherein:

said one of said first and second extreme ends of said upper limb is the lower end; and said one of said first and second extreme ends of said lower limb is the upper end, whereby said third tension means is coupled to the upper end of said upper limb, and said fourth tension means is coupled to the lower end of said lower limb.

4. A bow according to claim 1, wherein:

said one of said first and second extreme ends of said upper limb is the upper end; and said one of said first and second extreme ends of said lower limb is the lower end, whereby said third tension means is coupled by first coupling means to the upper end of said handle riser, and said fourth tension means is coupled by second coupling means to the lower end of said handle riser, said first coupling means having centerline in said plane and lying entirely above said axis of thrust and said second coupling means having centerline in said plane and lying entirely below said axis of thrust.

5. A bow according to claim 4, wherein:

said first coupling means comprises a first energy storage means attached to said upper end of said handle riser, and said third tension means comprises a cable connected to said first energy storage means and to said second cam surface of said first cam arrangement;

said second coupling means comprises a second energy storage means attached to said lower end of said handle riser, and said fourth tension means comprises a cable connected to said second energy storage means and to said second cam surface of said second cam arrangement.

6. A bow according to claim 5, wherein said first energy storage means comprises a first cantilever bar affixed to said upper end of said handle riser, and said second energy storage means comprises a second cantilever bar affixed to said lower end of said handle riser.

* * * * *